US009567986B2

(12) United States Patent
Perry

(10) Patent No.: US 9,567,986 B2
(45) Date of Patent: Feb. 14, 2017

(54) FLOW CONTROL FOR A HYDRAULIC SYSTEM

(71) Applicant: Caterpillar Inc., Peoria, IL (US)

(72) Inventor: Toby Perry, Minooka, IL (US)

(73) Assignee: Caterpillar Inc., Peoria, IL (US)

( * ) Notice: Subject to any disclaimer, the term of this patent is extended or adjusted under 35 U.S.C. 154(b) by 328 days.

(21) Appl. No.: 14/491,063

(22) Filed: Sep. 19, 2014

(65) Prior Publication Data

US 2016/0084212 A1 Mar. 24, 2016

(51) Int. Cl.

| | |
|---|---|
| ***F02N 7/08*** | (2006.01) |
| ***F04B 23/02*** | (2006.01) |
| ***F04B 23/04*** | (2006.01) |
| ***F04B 23/06*** | (2006.01) |
| ***F02N 7/00*** | (2006.01) |
| ***F04B 49/06*** | (2006.01) |
| ***F04B 49/22*** | (2006.01) |
| *F02N 7/06* | (2006.01) |
| *F02N 15/02* | (2006.01) |
| *F02N 15/06* | (2006.01) |

(52) U.S. Cl.

CPC ..... *F04B 23/02* (2013.01); *F02N 7/00* (2013.01); *F04B 23/04* (2013.01); *F04B 23/06* (2013.01); *F04B 49/06* (2013.01); *F04B 49/22* (2013.01); *F02N 7/06* (2013.01); *F02N 15/022* (2013.01); *F02N 15/06* (2013.01)

(58) Field of Classification Search

CPC ..... F04B 23/02; F04B 23/04; F04B 23/06; F04B 49/06; F04B 49/22; F02N 7/00; F02N 7/04; F02N 7/06

USPC ..... 123/179.31

See application file for complete search history.

(56) References Cited

U.S. PATENT DOCUMENTS

| | | | | |
|---|---|---|---|---|
| 3,861,144 | A * | 1/1975 | Woods | F15B 1/22 60/386 |
| 3,917,027 | A * | 11/1975 | Hakanson | F01M 5/00 123/179.31 |
| 4,875,551 | A * | 10/1989 | Lulich | F01M 5/025 123/179.1 |
| 2002/0166532 | A1* | 11/2002 | Mori | F02N 7/00 123/179.31 |
| 2005/0028759 | A1* | 2/2005 | Epshteyn | B60K 6/12 123/46 R |
| 2013/0178328 | A1* | 7/2013 | Arsenault | B60W 10/06 477/3 |
| 2014/0127036 | A1 | 5/2014 | Buckley et al. | |

(Continued)

FOREIGN PATENT DOCUMENTS

CN 203640601 U 6/2014

*Primary Examiner* — Hieu T Vo
*Assistant Examiner* — Arnold Castro

(57) ABSTRACT

A hydraulic system associated with an engine may include a hydraulic pump, a hydraulic tank, a hydraulic starter and a second pump. The hydraulic system may include a relief valve that allows hydraulic fluid to pass through the relief valve when pressure at the relief valve meets a predetermined pressure. As well, the hydraulic system may include a first solenoid valve and a second solenoid valve. The first solenoid valve may be coupled between the hydraulic pump and the second pump to thereby control fluid flow to the second pump. Additionally, the second solenoid valve may be coupled between the hydraulic pump and the hydraulic starter to thereby control fluid flow to the hydraulic starter.

20 Claims, 4 Drawing Sheets

(56) References Cited

U.S. PATENT DOCUMENTS

| | | | | |
|---|---|---|---|---|
| 2014/0165947 | A1* | 6/2014 | Krittian | F02N 11/0803 123/179.31 |
| 2014/0190157 | A1* | 7/2014 | Krittian | E02F 9/2066 60/445 |
| 2014/0208733 | A1* | 7/2014 | Krittian | F02N 7/00 60/413 |
| 2014/0283915 | A1* | 9/2014 | Ma | F15B 1/027 137/1 |

* cited by examiner

FLOW CONTROL FOR A HYDRAULIC SYSTEM

TECHNICAL FIELD

The disclosure is applicable to hydraulic systems having starter systems, and more specifically to hydraulic drive starter systems having a pre-lube pump on industrial machines having internal-combustion engines.

BACKGROUND

Hydraulic starters are used in various applications to initiate start-up of industrial engines, such as diesel engines. As well, pre-lube pumps can be coupled to industrial engines to lubricate the engine with oil before start-up. Pre-lube pumps can prevent dry start-ups where insufficient oil is present in various parts of the engine, which can greatly damage key engine components, such as bearings.

One example of a prior art system is an industrial engine that includes a hydraulic starter and a pre-lube pump. This application often uses a single spool valve to manage hydraulic fluid flow between the hydraulic starter and the pre-lube pump. As such, this arrangement can result in high system pressure in the hydraulic starter line to be communicated to a return line of the pre-lube pump. This high return line pressure can cause failures in various components operated by the hydraulic system including the shaft seal on the pre-lube pump. Similar systems using a single valve to operate multiple devices typically fail in the same way.

Another drawback is when a high-pressure event occurs at the industrial engine, an exterior relief valve may dump oil back to a tank. This can cause the flow to decrease on the industrial engine side of the system. When the pressure drops and full hydraulic fluid flow resumes at the industrial engine, the surge of fluid in the return line can cause excessive backpressure in the return line. This event can cause a failure of various components such as the pre-lube pump shaft seal.

SUMMARY

In one aspect, the disclosure describes a hydraulic system that includes a first hydraulic pump, a hydraulic tank coupled to the first hydraulic pump, a second pump unit coupled to the first hydraulic pump via a supply line and the hydraulic tank via a return line, wherein the second pump unit is drivably operated based on pressurized fluid discharged from the first hydraulic pump, a hydraulic starter coupled to the first hydraulic pump via the supply line and the hydraulic tank via the return line, wherein the hydraulic starter is drivably operated based on pressurized fluid discharged from the first hydraulic pump, a first solenoid valve on the supply line coupled between the first hydraulic pump and the second pump, wherein the first solenoid valve is selectively movable between an open position and a closed position, a second solenoid valve on the supply line coupled between the first hydraulic pump and the hydraulic starter, wherein the second solenoid valve is selectively movable between an open position and a closed position, and a relief valve coupled between the supply line and the return line upstream of the first and second solenoid valves, wherein the relief valve is movable to an open position when hydraulic pressure in the supply line is greater than a predetermined pressure to thereby allow hydraulic fluid to move through the relief valve to the return line to the hydraulic tank.

In another aspect, the disclosure describes a valve assembly that includes a first port configured to be hydraulically coupled to a first hydraulic pump, a second port configured to be hydraulically coupled to a hydraulic tank, a third port and a fourth port configured each to be hydraulically coupled to corresponding ends of a hydraulic starter, a fifth port and a sixth port configured to be hydraulically coupled to corresponding ends of a second pump, a relief valve hydraulically coupled between the first port and the second port, wherein the relief valve is configured to open when hydraulic pressure is greater than a predetermined pressure to thereby allow hydraulic fluid to move through the relief valve to the second port, and wherein the relief valve is configured to close when the hydraulic pressure is less than the predetermined pressure to prevent hydraulic fluid from moving through the relief valve to the second port, a first solenoid valve hydraulically coupled between the first port and the fifth port, wherein the first solenoid valve is movable between an open position and a closed position, wherein when the first solenoid valve is in the open position, hydraulic fluid is allowed to move from the first port to the fifth port, and wherein when the first solenoid valve is in the closed position, hydraulic fluid is prevented from moving from the first port to the fifth port, and a second solenoid valve hydraulically coupled between the first port and the third port, wherein the second solenoid valve is movable between an open position and a closed position, wherein when the second solenoid valve is in the open position, hydraulic fluid is allowed to move from the first port to the third port, and wherein when the second solenoid valve is in the closed position, hydraulic fluid is prevented from moving from the first port to the third port.

In yet another aspect, the disclosure describes a method of operating a hydraulic system, that includes pressurizing hydraulic fluid via a first hydraulic pump that is coupled to a hydraulic tank, moving a first solenoid valve to an open position to provide hydraulic fluid to operate a second pump, wherein the second pump provides lubrication fluid to an engine, moving the first solenoid valve to a closed position once the second pump has lubricated the engine, moving a second solenoid valve to an open position to provide hydraulic fluid to operate a hydraulic starter, wherein the hydraulic starter initiates a start-up process of the engine, and moving the second solenoid valve to a closed position once the hydraulic starter has initiated the start-up process of the engine.

DETAILED DESCRIPTION

Figure 1:
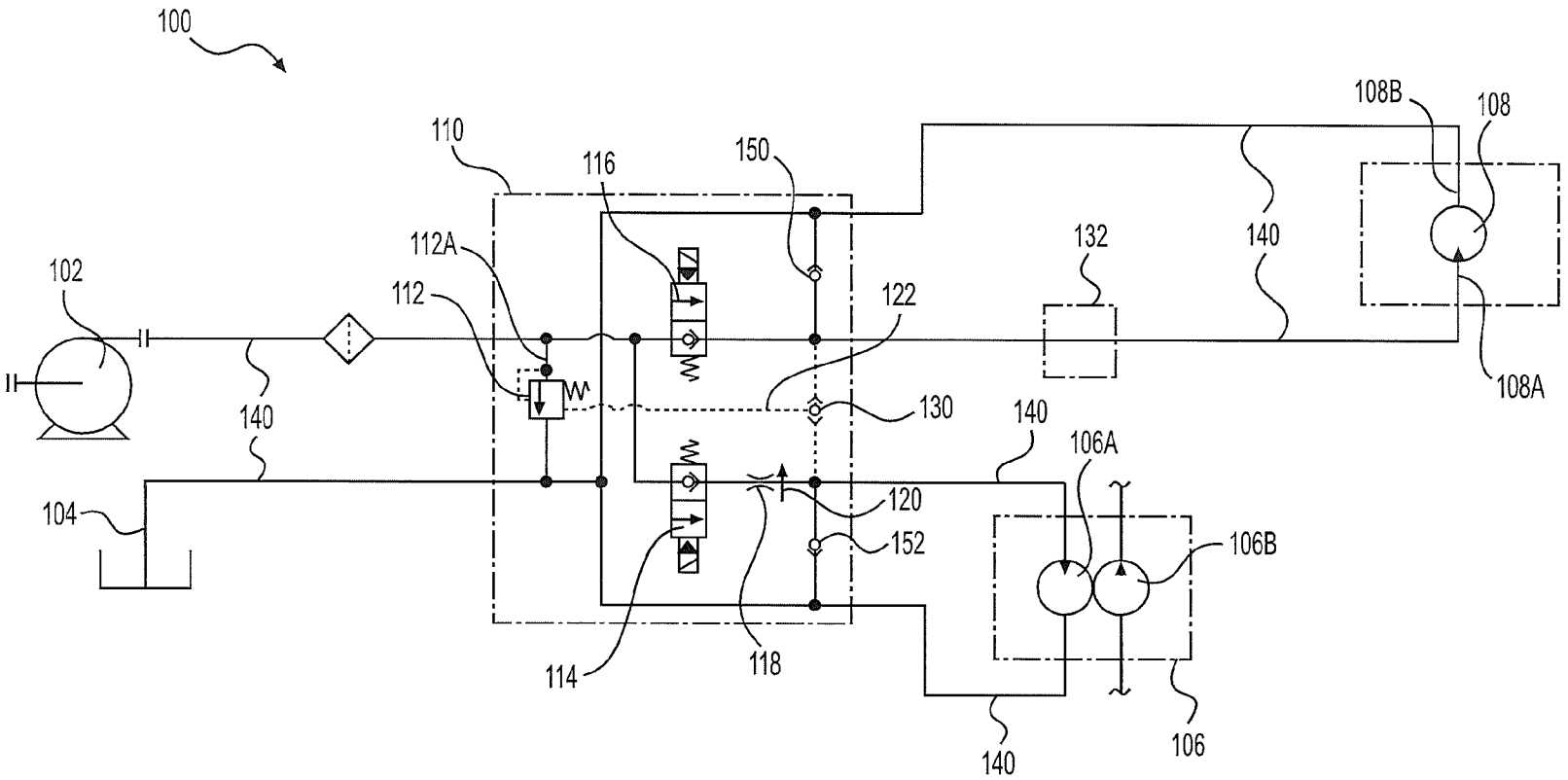
FIG. 1 is a schematic representation of a hydraulic system according to an aspect of the disclosure.

Now referring to the drawings, FIG. 1 illustrates a hydraulic system 100 constructed in accordance with the disclosure. While this disclosure does not recite any specific machine for which the hydraulic system 100 may be incorporated, it is to be understood that the teachings of this disclosure could be used with any industrial machine including, but not limited to, marine engines, track machines, hydraulic fracturing (or well stimulation) trailers, graders, dump trucks, hydraulic excavators, backhoe loaders, motor graders, off-highway trucks, wheel loaders, agricultural tractors, locomotives and any industrial machine having an internal-combustion engine.

Figure 3:
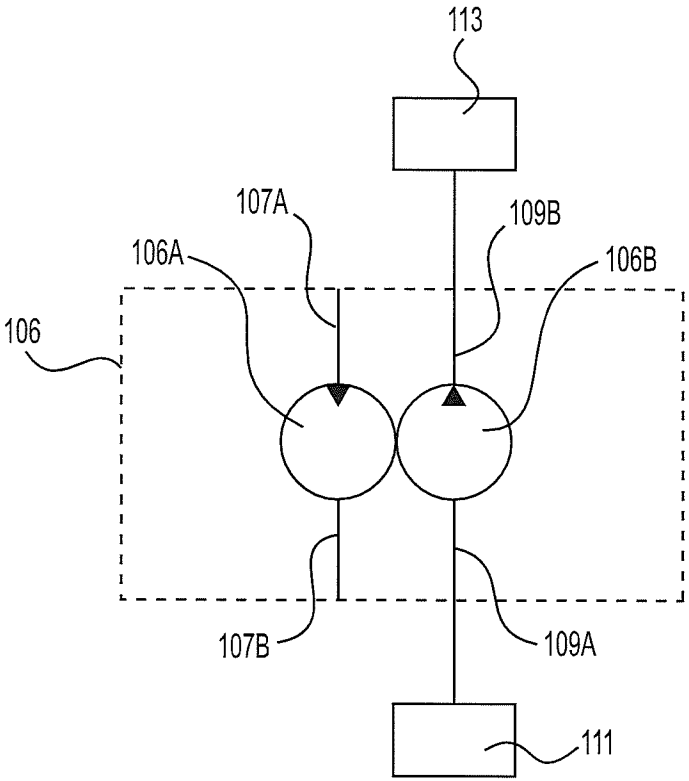
FIG. 3 is a fragmentary perspective view of a pre-lube pump coupled to a reservoir and an inlet of an engine according to an aspect of the disclosure.

As illustrated, the hydraulic system 100 may include a primary hydraulic pump 102 and a hydraulic tank 104 fluidly coupled to the hydraulic pump 102. The hydraulic system 100 may include a secondary pump, such as a pre-lube pump 106, coupled to the hydraulic pump 102 and the hydraulic tank 104. The hydraulic pump 102 may provide pressurized hydraulic fluid through the hydraulic system 100, via hydraulic lines 140. Accordingly, the pressurized hydraulic fluid may actuate various components, such as the pre-lube pump 106. As shown in FIG. 3, the pre-lube pump 106 is a pump/motor hydraulic unit that includes a hydraulic motor 106A drivably coupled to a second hydraulic pump 106B. The inlet 107A of the hydraulic motor 106A is fluidly coupled to the hydraulic line 140 and configured to receive the pressurized hydraulic fluid from the hydraulic pump 102. The outlet 107B of the hydraulic motor 106A is coupled to the tank 104 via the hydraulic lines 140. Rotation of the hydraulic motor 106A can be operable to drive the shaft (not shown) of the second hydraulic pump 106B. The inlet 109A of second hydraulic pump 106B is coupled to a reservoir 111 of a fluid. The second hydraulic pump 106B is configured to provide a pressurized fluid via the outlet 109B. It should be appreciated that the pressurized fluid may be different than the hydraulic fluid pressurized by the primary pump 102, to another component.

While not illustrated in FIG. 1, when operated, the discharge of pre-lube pump 106 may be coupled to an inlet 113 of an industrial engine. As such, when the pre-lube pump 106 is actuated, the pre-lube pump 106 may pump an engine lubrication fluid through the industrial engine to thereby lubricate the industrial engine prior to start-up. Pre-lubricating the industrial engine may allow the industrial engine to start-up from a dry condition and may increase the life of the industrial engine. Moreover, pre-lubricating the industrial engine may allow the industrial engine to start-up more quickly as it is better lubricated. It should be appreciated that "coupled" may refer to any connection type, such as hydraulically coupled, operatively coupled, and the like. The industrial engine may include at least one piston, piston rings, crankshaft, connecting rods, valves, cooling system, intake system, exhaust system, fuel system, and the like.

The hydraulic system 100 may also include a hydraulic starter 108 coupled to the hydraulic pump 102 and the hydraulic tank 104. Similar to the pre-lube pump 106, the hydraulic starter 108 may be actuated by hydraulic fluid that is pressurized by the pumping action of the hydraulic pump 102. As well, while not illustrated in FIGS. 1 and 3, the hydraulic starter 108 may be coupled to a mechanical start up (not shown), such as a starter clutch device, of the industrial engine. Accordingly, in response to receiving pressurized fluid from the primary pump, the hydraulic starter 108 may at least rotate and shift axially to engage the mechanical start up to actuate the operation of the industrial engine. For example, in some aspects, pressurized hydraulic fluid may enter an inlet port of the hydraulic starter 108. Pistons (not shown) on the inlet side 108A of the hydraulic starter 108 may become filled with hydraulic fluid, which may thereby cause rotation of the hydraulic starter shaft (not shown). As the pistons and motor shaft spin, depressurized hydraulic fluid may be drained through the outlet side 108B of the hydraulic starter 108. The starter shaft may also include a pinion gear (not shown). During rotation of the starter shaft, the pinion gear may move along the starter shaft towards a flywheel ring gear of the engine, whereby the pinion gear may become rotatably coupled to the ring gear. In effect, the ring gear may transfer torque from the hydraulic starter to rotate the engine to begin operation.

In order to control pressurized hydraulic fluid within the hydraulic system 100, the system 100 may include a valve assembly 110 with a plurality of ports to be hydraulically coupled to various components of the system 100. Some aspects of the valve assembly 110 include a first port 180 configured to be hydraulically coupled to the hydraulic pump 102 and a second port 182 configured to be hydraulically coupled to a hydraulic tank 104. As well, the valve assembly 110 may include a third port 184 and a fourth port 186 configured each to be hydraulically coupled to corresponding ends of the hydraulic starter 108. Specifically, the third port 184 may be coupled to an inlet of the hydraulic starter 108, while the fourth port 186 may be coupled to an outlet of the hydraulic starter 108. Furthermore, in some aspects, the valve assembly 110 includes a fifth port 188 and a sixth port 190 configured to be hydraulically coupled to corresponding ends of the pre-lube pump 106. As well, the fifth port 188 may be coupled to an inlet of the pre-lube pump 106, while the sixth port 190 may be coupled to an outlet of the pre-lube pump 106.

Figure 2:
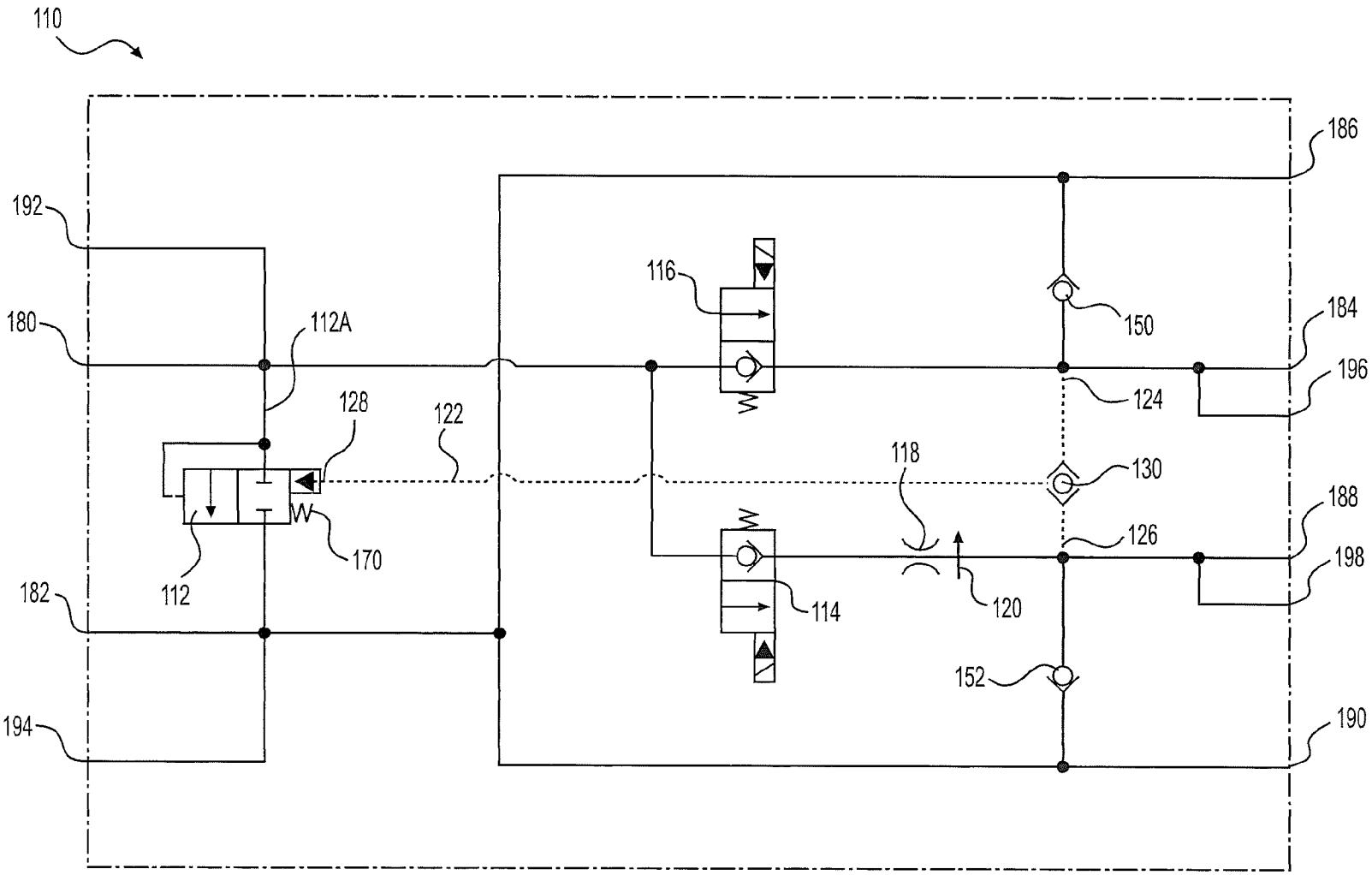
FIG. 2 is a fragmentary perspective view of a valve assembly according to an aspect of the disclosure.

With reference to FIGS. 1 and 2, some aspects of the valve assembly 110 may include a relief valve 112, or unloading valve, hydraulically coupled between the first port 180 and the second port 182. With respect to the overall hydraulic system 100, the relief valve 112 may be coupled between the hydraulic pump 102 and the hydraulic tank 104. In other words, the relief valve 112 may be coupled downstream from the hydraulic pump 102 and upstream from the hydraulic tank 104.

The relief valve 112 may be movable between an open position and a closed position. The relief valve 112 may be spring biased to the closed position via a spring force that is exerted by a spring 170 that is included within the relief valve 112. Accordingly, the relief valve 112 may be configured to open when hydraulic fluid pressure at the inlet of the relief valve 112A is greater than a predetermined pressure. In some aspects, the predetermined pressure is equal to a corresponding spring pressure from the spring force of the spring 170 plus a hydraulic fluid pressure from a hydraulic line 122. In this manner, when the hydraulic pressure overcomes the spring pressure, the spring 170 may retract to thereby cause the relief valve 112 to open. As such, when the relief valve 112 opens, this may allow hydraulic fluid to move through the relief valve 112 to the second port 182 and into the hydraulic tank 104. Moreover, the relief valve 112 may be configured to close when the hydraulic pressure at the inlet of the relief valve 112A is less than the predetermined pressure. In this manner, the hydraulic pressure may not be high enough to overcome the predetermined pressure of the spring 170. As such, the relief valve 112 may close and thereby prevent hydraulic fluid from moving through the relief valve 112 to the second port 182 and into the hydraulic tank 104.

The hydraulic system 100, via the valve assembly 110, may include a first valve and a second valve configured to divert pressurized hydraulic fluid throughout the hydraulic system 100. For example, as illustrated in FIGS. 1 and 2, the hydraulic system 100 may include a first solenoid valve 114 coupled between the first port 180 and the fifth port 188.

With respect to the hydraulic system 100, the first solenoid valve 114 may be coupled between the hydraulic pump 102 and the pre-lube pump 106.

The first solenoid valve 114 may be movable between an open position and a closed position. When the first solenoid valve 114 is in the open position, hydraulic fluid may be allowed to flow from the hydraulic pump 102, to the first port 180, through the first solenoid valve 114, to the fifth port 188, and ultimately to the pre-lube pump 106. Accordingly, when the first solenoid valve 114 is in the closed position, the hydraulic fluid may be prevented from moving from the hydraulic pump 102 to the pre-lube pump 106. In other words, the hydraulic fluid may be prevented from moving from the first port 180 through the first solenoid valve 114 to the fifth port 188.

With continued reference to FIGS. 1 and 2, the hydraulic system 100 may also include a second solenoid valve 116 coupled between the first port 180 and the third port 184. With respect to the hydraulic system 100, the second solenoid valve 116 may be coupled between the hydraulic pump 102 and the hydraulic starter 108. More specifically, the second solenoid valve 116 may be coupled downstream from the hydraulic pump 102 and upstream from the hydraulic starter 108.

The second solenoid valve 116 may be movable between an open position and a closed position. When the second solenoid valve 116 is in the open position, hydraulic fluid may be allowed to flow from the hydraulic pump 102, to the first port 180, through the second solenoid valve 116, to the third port 184, and ultimately to the hydraulic starter 108. As well, when the second solenoid valve 116 is in the closed position, the hydraulic fluid may be prevented from moving from the hydraulic pump 102 to the hydraulic starter 108. In other words, the hydraulic fluid may be prevented from moving from the first port 180 through the second solenoid valve 116 to the third port 184.

The first and second solenoid valves 114 and 116 may be electronically actuated, such as with an electric current. Specifically, the first solenoid valve 114 may be actuated with a first electric current, and the second solenoid valve 116 may be electronically actuated with a second electric current. It should be appreciated that the first and second electric currents can be the same or different. Furthermore, while FIGS. 1 and 2 disclose solenoid valves, it should also be appreciated that the hydraulic system 100 may use any type of valve or hydraulic component, such as an electromechanical valve or a mechanical valve that is configured to divert pressurized fluid.

In order to control the flow of hydraulic fluid throughout the hydraulic system 100, the first and second solenoid valves 114 and 116 may be configured to move dependently or independently with respect to each other. For example, during dependent operation, when the first solenoid valve 114 is in the open position, the second solenoid valve 116 may be in the closed position. Accordingly, when the second solenoid valve 116 is in the open position, the first solenoid valve 114 may be in the closed position. However, this is just one of many examples, and it should be appreciated that the first and second solenoid valves 114 and 116 may be configured to move in any manner that is dependent or independent upon the other respective solenoid valve.

To complete the flow of hydraulic fluid from the hydraulic pump 102 through the hydraulic system 100 and into the hydraulic tank 104, the hydraulic starter 108 and the pre-lube pump 106 may direct hydraulic fluid through the fourth port 186 and sixth port 190, respectively, and into the hydraulic tank 104. In this manner, both the fourth port 186 and the sixth port 190 may be hydraulically coupled to the second port 182. As such, the second port 182 may be hydraulically coupled to the hydraulic tank 104 to thereby allow hydraulic fluid to be directed into the hydraulic tank 104 and thereby complete the flow throughout the system.

In some aspects, the pre-lube pump 106 may be actuated by a first hydraulic fluid flow, while the hydraulic starter 108 may be actuated by a second hydraulic fluid flow. The first hydraulic fluid flow may be any fluid flow that is less than the second hydraulic fluid flow. For example, in one aspect the first hydraulic fluid flow is between 1-5 gallons per minute; and in a further aspect the first hydraulic flow is approximately 3 gallons per minute. In one aspect, the second hydraulic fluid flow is 30-50 gallons per minute; and in a further aspect the second hydraulic flow is approximately 40 gallons per minute.

In order to reduce the first hydraulic fluid flow with respect to the second hydraulic fluid flow, the hydraulic system 100 may include a flow restriction 118 coupled between the first solenoid valve 114 and the pre-lube pump 106. In other words, the flow restriction 118 may be coupled downstream from the first solenoid valve 114 and upstream from the pre-lube pump 106. In this manner, the flow restriction 118 may restrict the flow rate of hydraulic fluid received at the pre-lube pump 106.

In some aspects, the hydraulic system 100 may further include a pressure compensator 120 coupled across the flow restriction 118. In this regard, the pressure compensator 120 may minimize the pressure variations in the hydraulic fluid flow rate across the flow restriction 118. As such, by maintaining a constant pressure differential across the flow restriction 118, the system may maintain a constant flow rate.

As further illustrated in FIGS. 1 and 2, some aspects of the hydraulic system 100 include a hydraulic line 122, such as a signaling line, for communicating the pressure at various points in the system 100. In some aspects, the hydraulic line 122 includes a first end 124, a second end 126, and a third end 128. The first end 124 may be coupled between the second solenoid valve 116 and the hydraulic starter 108, or third port 184. Moreover, the second end 126 may be coupled between the first solenoid valve 114 and the pre-lube pump 106, or fifth port 188. Furthermore, the third end 128 may be coupled to the relief valve 112. In some aspects, the predetermined pressure may equal the combination of the spring pressure plus hydraulic fluid pressure from the hydraulic line 122.

The hydraulic line 122 may further include a shuttle valve 130 coupled to the hydraulic line 122. In this configuration, the hydraulic line 122 may include two hydraulic inlet lines and one hydraulic outlet line, whereby the shuttle valve 130 may be coupled between the two inlet lines and the outlet line. As such, the hydraulic fluid may flow from the first inlet line or the second inlet line into the outlet line, which may be coupled to the relief valve 112.

The shuttle valve 130 may be configured to communicate hydraulic fluid pressure from a hydraulic starter side of the hydraulic system 100 to the relief valve 112. In this manner, the hydraulic fluid pressure may be communicated from the second solenoid valve 116 to the relief valve 112. As well, the shuttle valve 130 may be configured to communicate the hydraulic fluid pressure from a pre-lube pump side of the hydraulic system 100 to the relief valve 112. In other words, the hydraulic fluid pressure may be communicated from the first solenoid valve 114 to the relief valve 112. With this arrangement, the shuttle valve 130 may be configured to communicate the highest pressure between the first end 124 and the second end 126 to the relief valve 112. In this manner, the pressure required to open the relief valve 112 could vary based on the hydraulic fluid pressure within hydraulic line 122.

With reference to FIG. 1, some aspects of the hydraulic system 100 include an engagement valve 132 coupled between the first solenoid valve 114 and the hydraulic starter 108. The engagement valve 132 may be any valve configured to increase the flow of hydraulic fluid to the hydraulic starter 108 at a predetermined rate. In other words, the engagement valve 132 may be configured to gradually increase the flow of hydraulic fluid to the hydraulic starter 108. It should be appreciated that the predetermined rate may be any linear or non-linear increase in the flow of hydraulic fluid so as to safely engage the hydraulic starter 108 to thereby reduce damage to the hydraulic starter 108 from sudden surges in flow. It should also be appreciated that the engagement valve 132 may be referred to as a soft engagement valve.

The engagement valve 132 may gradually increase the flow of hydraulic fluid via one or more bypass lines and a hydraulically actuated two-way valve. For example, a first bypass line may bypass the two-way valve, whereby the first bypass line may include a first flow restriction that may be in fluid communication with the hydraulic starter 108. In this regard, pressurized hydraulic fluid may flow through the first bypass line whereby the flow is reduced before entering the inlet 108A of the hydraulic starter 108. This may effectively reduce the flow of pressurized hydraulic fluid to the hydraulic starter 108. The first bypass line may also be in fluid communication with the hydraulically actuated two-way valve that is normally closed to prevent hydraulic fluid from flowing through the two-way valve and into the inlet 108A of the hydraulic starter 108. The first bypass line may also include a second flow restriction that is in fluid communication with the two-way valve. In this manner, fluid flowing through the second flow restriction may provide pressure on the two-way valve to move from the normally closed position to the open position. When the two-way valve moves to the open position, fully pressurized hydraulic fluid may be allowed to flow through the two-way valve and into the inlet 108A of the hydraulic starter 108. As such, the flow of pressurized hydraulic fluid into the inlet 108A of the hydraulic starter 108 may gradually increase at a predetermined rate.

The hydraulic system 100 may also include one or more one-way valves, such as check valves, to control the direction of hydraulic fluid flow within the system 100. The one or more one-way valves may ensure that hydraulic fluid properly flows throughout the hydraulic system 100 and does not back-up or reverse flow, which may damage components and/or impair performance of the system 100.

Accordingly, in some aspects, the hydraulic system 100 includes a first one-way valve 150 coupled downstream from the hydraulic starter 108 and upstream from the hydraulic tank 104. With respect to the valve assembly 110, the first one-way valve 150 may be coupled downstream from the fourth port 186 and upstream from the third port 184.

Some aspects of the hydraulic system 100 also include a second one-way valve 152 coupled downstream from the pre-lube pump 106 and upstream from the hydraulic tank 104. In this manner, the second one-way valve 152 may be coupled downstream from the sixth port 190 and upstream from the fifth port 188.

Some aspects of the hydraulic system 100 include a plurality of gauge ports configured to indicate pressure at various points within the system 100. For example, the valve assembly 110 may include a first gauge port 192 hydraulically coupled to the first port 180. Accordingly, the first gauge port 192 may be configured to indicate pressure at the hydraulic pump 102. As well, the valve assembly 110 may include a second gauge port 194 hydraulically coupled to the second port 182. In this manner, the second gauge port 194 may be configured to indicate pressure at the hydraulic tank 104.

The valve assembly 110 may also include gauge ports configured to indicate pressure at the pre-lube pump 106 and the hydraulic starter 108. For example, the valve assembly 110 may include a third gauge port 196 hydraulically coupled to the third port 184, and a fourth gauge port 198 hydraulically coupled to the fifth port 188. As such, the third gauge port 196 may be configured to indicate pressure at the hydraulic starter 108, and the fourth gauge port 198 may be configured to indicate pressure at the pre-lube pump 106.

Figure 4:
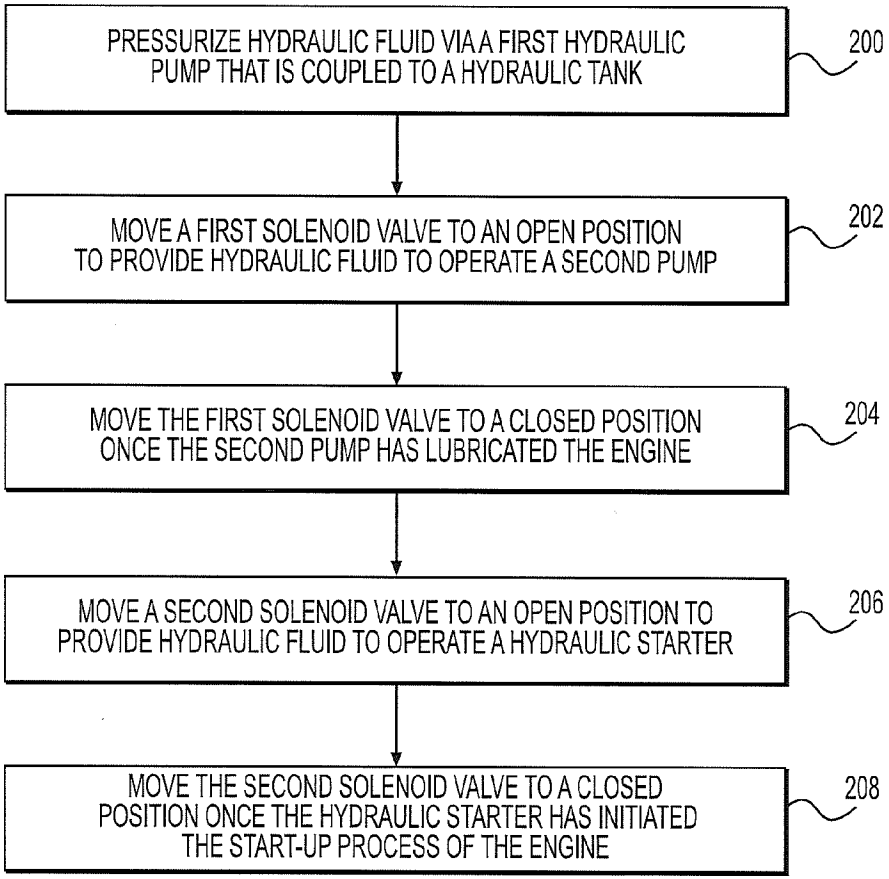
FIG. 4 is a flow chart showing a method of operation according to an aspect of the disclosure.

The disclosure also includes a method of operating the hydraulic system 100. As illustrated in FIG. 4, the method may include pressurizing hydraulic fluid via a first hydraulic pump 102 that is coupled to a hydraulic tank 104 (at step 200). The method may also include moving a first solenoid valve 114 to an open position to provide hydraulic fluid to operate a pre-lube pump 106 (at step 202). In doing so, the pre-lube pump 106 may provide lubrication fluid to the industrial engine. As well, the method may include moving the first solenoid valve 114 to a closed position once the pre-lube pump 106 has lubricated the industrial engine (at step 204). In some aspects, the method further includes moving a second solenoid valve 116 to an open position to provide hydraulic fluid to operate a hydraulic starter 108 and thereby initiate the start-up process of the engine (at step 206). As well, some aspects further include moving the second solenoid valve 116 to a closed position once the hydraulic starter 108 has initiated the start-up process of the engine (at step 208).

In some aspects, the method includes monitoring a parameter of the lubrication fluid within the engine. The parameter may represent a pressure of lubrication fluid within the engine. Accordingly, in response to the parameter reaching a predetermined pressure, the first solenoid valve 114 may move to the closed position. It should be appreciated that the predetermined pressure may be equal to any amount of pressure whereby the engine is sufficiently pre-lubricated with lubrication fluid to begin the start-up process.

Hydraulic fluid flow in the hydraulic system 100 may be described as a first hydraulic fluid flow and a second hydraulic fluid flow. For example, providing hydraulic fluid to operate the second pump may comprise providing a first hydraulic fluid flow to operate the pre-lube pump 106. As well, providing hydraulic fluid to operate the hydraulic starter 108 may comprise providing a second hydraulic fluid flow to operate the hydraulic starter 108. In this regard, some aspects of the method may include reducing the first hydraulic fluid flow with respect to the second hydraulic fluid flow via the flow restriction 118. As well, some aspects may further include coupling the pressure compensator 120 across the flow restriction 118.

In some aspects, operating the hydraulic starter 108 includes rotating a shaft, such as a motor shaft (not shown), of the hydraulic starter 108. As well, operating the hydraulic starter 108 may include coupling a rotating portion of the hydraulic starter 108, such as a pinion gear, to a ring gear of the engine to thereby initiate the start-up process of the engine. It should be appreciated that any of the steps described in this disclosure may be initiated via a controller, such as a microcontroller.

The disclosure also includes a method of manufacturing the hydraulic system 100. The method may include coupling the first port 180 of the valve assembly 110 to the hydraulic pump 102. This may allow the valve assembly 110 to receive hydraulic fluid from the hydraulic pump 102, which can then be routed to the rest of the hydraulic system 100. The method may also include coupling the second port 182 to the hydraulic tank 104. As such, the valve assembly 110 may be allowed to drain hydraulic fluid from the hydraulic system 100 into the hydraulic tank 104.

The method may also include coupling the relief valve 112 between the first port 180 and the second port 182. The relief valve 112 may be configured to open when the hydraulic fluid pressure at the inlet of the relief valve 112A is greater than the predetermined pressure, which may allow hydraulic fluid to move from the first port 180, through the relief valve 112, to the second port 182, and in to the hydraulic tank 104.

In some aspects, the method includes coupling the pre-lube pump 106 and the hydraulic starter 108 to the valve assembly 110. The method may also include coupling the third port 184 and the fourth port 186 to corresponding ends of the hydraulic starter 108, as well as coupling the fifth port 188 and the sixth port 190 to corresponding ends of the pre-lube pump 106. Accordingly, the valve assembly 110 may divert pressurized hydraulic fluid to the pre-lube pump 106 and the hydraulic starter 108 to thereby actuate the pre-lube pump 106 and the hydraulic starter 108. Specifically, the hydraulic starter 108 and the pre-lube pump 106 may receive pressurized hydraulic fluid from the third port 184 and the fifth port 188, respectively. Accordingly, the hydraulic starter 108 and the pre-lube pump 106 may direct hydraulic fluid through the fourth port 186 and sixth port 190, respectively, and ultimately into the hydraulic tank 104.

Furthermore, some aspects of the method may include coupling the fourth port 186 to the second port 182 and coupling the sixth port 190 to the second port 182. This may allow the pre-lube pump 106 and the hydraulic starter 108 to be connected to the hydraulic tank 104 so that the pre-lube pump 106 and the hydraulic starter 108 can direct hydraulic fluid to the hydraulic tank 104.

Because the flow and pressure requirements of the pre-lube pump 106 are less than the hydraulic starter 108, the method may also include coupling a flow restriction 118 between the first solenoid valve 114 and the fifth port 188, and coupling a pressure compensator 120 across the flow restriction 118. These may reduce the flow and pressure of the hydraulic fluid being fed to the pre-lube pump 106. In effect, this may allow the hydraulic pump 102 to effectively transmit pressurized hydraulic fluid to both the pre-lube pump 106 and the hydraulic starter 108.

In order to determine pressure at various points in the hydraulic system 100, the method may also include coupling a hydraulic line 122, or sampling line, to the hydraulic system 100. Specifically, the method may include coupling the first end 124 of the hydraulic line 122 between the second solenoid valve 116 and the third port 184 and coupling the second end 126 of the hydraulic line 122 between the first solenoid valve 114 and the fifth port 188. As well, the method may include coupling the third end 128 of the hydraulic line 122 to the relief valve 112.

Additionally, so as to promote proper directional flow throughout the hydraulic system 100, the method may also include coupling the shuttle valve 130 and one or more one-way valves to the hydraulic system 100. In some aspects, the method includes coupling the shuttle valve 130 to the hydraulic line 122 between the first end 124, the second end 126 and the third end 128. The shuttle valve 130 may be configured so that hydraulic fluid is allowed to flow from the second solenoid valve 116 to the relief valve 112, and hydraulic fluid is allowed to flow from the first solenoid valve 114 to the relief valve 112. As well, the method may include coupling a first one-way valve 150 between the third port 184 and the fourth port 186, and coupling a second one-way valve 152 between the fifth port 188 and the sixth port 190.

INDUSTRIAL APPLICABILITY

The disclosure is applicable to hydraulic systems on machines, and more specifically to hydraulic drive starter systems on industrial machines having internal-combustion engines. Examples of industrial machines include, but are not limited to marine engines, track machines, hydraulic fracturing (or well stimulation) trailers, graders, dump trucks, hydraulic excavators, backhoe loaders, motor graders, off-highway trucks, wheel loaders, agricultural tractors, locomotives and any industrial machine having an internal-combustion engine. In general, it should be appreciated that the teachings of the disclosure can find industrial applicability in any number of different situations, such as any type of internal-combustion engine that is coupled to a starter system.

In one embodiment, internal-combustion engines can require a starter system to initiate the engine's operation so the engine is able to operate under its own power. During the startup process, high system pressure can occur at various components within hydraulic systems. Some of the components may not be suited for such pressure. Accordingly, the foregoing hydraulic system 100 and/or valve assembly 110 can be implemented in such situations to thereby reduce pressure at specific components so as to reduce damage. As such, the disclosed hydraulic system 100 and/or valve assembly 110 may reduce the occurrence of breakdowns, decrease maintenance and replacement costs, and ultimately prolong the usable life of the industrial engine.

It will be appreciated that the foregoing description provides examples of the disclosed system and technique. However, it is contemplated that other implementations of the disclosure may differ in detail from the foregoing examples. All references to the disclosure or examples thereof are intended to reference the particular example being discussed at that point and are not intended to imply any limitation as to the scope of the disclosure more generally. All language of distinction and disparagement with respect to certain features is intended to indicate a lack of preference for those features, but not to exclude such from the scope of the disclosure entirely unless otherwise indicated.

Recitation of ranges of values herein are merely intended to serve as a shorthand method of referring individually to each separate value falling within the range, unless otherwise indicated herein, and each separate value is incorporated into the specification as if it were individually recited herein. All methods described herein may be performed in any suitable order unless otherwise indicated herein or otherwise clearly contradicted by context.

I claim:

1. A hydraulic system, comprising:

a first hydraulic pump;

a hydraulic tank coupled to the first hydraulic pump;

a second pump unit coupled to the first hydraulic pump via a supply line and the hydraulic tank via a return line, wherein the second pump unit is drivably operated based on pressurized fluid discharged from the first hydraulic pump;

a hydraulic starter coupled to the first hydraulic pump via the supply line and the hydraulic tank via the return line, wherein the hydraulic starter is drivably operated based on pressurized fluid discharged from the first hydraulic pump;

a first solenoid valve on the supply line coupled between the first hydraulic pump and the second pump, wherein the first solenoid valve is selectively movable between an open position and a closed position;

a second solenoid valve on the supply line coupled between the first hydraulic pump and the hydraulic starter, wherein the second solenoid valve is selectively movable between an open position and a closed position; and a relief valve coupled between the supply line and the return line upstream of the first and second solenoid valves, wherein the relief valve is movable to an open position when hydraulic pressure in the supply line is greater than a predetermined pressure to thereby allow hydraulic fluid to move through the relief valve to the return line to the hydraulic tank.

2. The hydraulic system of claim 1, further comprising a flow restriction coupled between the first solenoid valve and the second pump.

3. The hydraulic system of claim 2, further comprising a pressure compensator coupled across the flow restriction.

4. The hydraulic system of claim 1, further comprising a hydraulic line having a first end coupled between the second solenoid valve and the hydraulic starter, a second end coupled between the first solenoid valve and the second pump, and a third end coupled to the relief valve, wherein the relief valve is spring biased to the closed position via a spring force, and the predetermined pressure equals the spring force and pressure from the hydraulic line.

5. The hydraulic system of claim 4, further comprising a shuttle valve coupled to the hydraulic line, wherein in response to the first end of the hydraulic line having a higher pressure than the second end of the hydraulic line, the shuttle valve communicates hydraulic fluid pressure from the first end of the hydraulic line to the relief valve, and wherein in response to the second end of the hydraulic line having a higher pressure than the first end of the hydraulic line, the shuttle valve communicates hydraulic fluid pressure from the second end of the hydraulic line to the relief valve.

6. The hydraulic system of claim 1, further comprising an engagement valve coupled between the first solenoid valve and the hydraulic starter, wherein the engagement valve is configured to increase flow of hydraulic fluid to the hydraulic starter at a predetermined rate.

7. The hydraulic system of claim 1, further comprising a first one-way valve coupled downstream from the hydraulic starter and upstream from the hydraulic tank.

8. The hydraulic system of claim 7, further comprising a second one-way valve coupled downstream from the second pump and upstream from the hydraulic tank.

9. The hydraulic system of claim 1, wherein when the first solenoid valve is in the closed position, the second solenoid valve is in the open position, and wherein when the second solenoid valve is in the closed position, the first solenoid valve is in the open position.

10. A valve assembly, comprising:

a first port configured to be hydraulically coupled to a first hydraulic pump;

a second port configured to be hydraulically coupled to a hydraulic tank;

a third port and a fourth port configured each to be hydraulically coupled to corresponding ends of a hydraulic starter;

a fifth port and a sixth port configured to be hydraulically coupled to corresponding ends of a second pump;

a relief valve hydraulically coupled between the first port and the second port, wherein the relief valve is configured to open when hydraulic pressure is greater than a predetermined pressure to thereby allow hydraulic fluid to move through the relief valve to the second port, and wherein the relief valve is configured to close when the hydraulic pressure is less than the predetermined pressure to prevent hydraulic fluid from moving through the relief valve to the second port;

a first solenoid valve hydraulically coupled between the first port and the fifth port, wherein the first solenoid valve is movable between an open position and a closed position, wherein when the first solenoid valve is in the open position, hydraulic fluid is allowed to move from the first port to the fifth port, and wherein when the first solenoid valve is in the closed position, hydraulic fluid is prevented from moving from the first port to the fifth port; and a second solenoid valve hydraulically coupled between the first port and the third port, wherein the second solenoid valve is movable between an open position and a closed position, wherein when the second solenoid valve is in the open position, hydraulic fluid is allowed to move from the first port to the third port, and wherein when the second solenoid valve is in the closed position, hydraulic fluid is prevented from moving from the first port to the third port.

11. The valve assembly of claim 10, wherein the fourth port is hydraulically coupled to the second port, and the sixth port is hydraulically coupled to the second port, the valve assembly further comprising a flow restriction coupled between the first solenoid valve and the fifth port.

12. The valve assembly of claim 11, further comprising a pressure compensator coupled across the flow restriction.

13. The valve assembly of claim 10, further comprising a hydraulic line having a first end coupled between the first solenoid valve and the fifth port, a second end coupled between the second solenoid valve and the third port, and a third end coupled to the relief valve, wherein the relief valve is spring biased to the closed position via a spring force, and the predetermined pressure equals the spring force and pressure from the hydraulic line.

14. The valve assembly of claim 13, further comprising a shuttle valve coupled to the hydraulic line, wherein the shuttle valve allows hydraulic fluid to flow from the first solenoid valve to the relief valve, or from the second solenoid valve to the relief valve.

15. The valve assembly of claim 10, further comprising:

a first one-way valve coupled downstream from the fourth port and upstream from the third port; and a second one-way valve coupled downstream from the sixth port and upstream from the fifth port.

16. The valve assembly of claim 10, further comprising:

a first gauge port hydraulically coupled to the first port, wherein the first gauge port is configured to indicate pressure at the first hydraulic pump;

a second gauge port hydraulically coupled to the second port, wherein the second gauge port is configured to indicate pressure at the hydraulic tank;

a third gauge port hydraulically coupled to the third port, wherein the third gauge port is configured to indicate pressure at the hydraulic starter; and a fourth gauge port hydraulically coupled to the fifth port, wherein the fourth gauge port is configured to indicate pressure at the second pump.

17. A method of operating a hydraulic system, comprising:

pressurizing hydraulic fluid via a first hydraulic pump that is coupled to a hydraulic tank;

moving a first solenoid valve to an open position to provide hydraulic fluid to operate a second pump, wherein the second pump provides lubrication fluid to an engine;

moving the first solenoid valve to a closed position once the second pump has lubricated the engine;

moving a second solenoid valve to an open position to provide hydraulic fluid to operate a hydraulic starter, wherein the hydraulic starter initiates a start-up process of the engine; and moving the second solenoid valve to a closed position once the hydraulic starter has initiated the start-up process of the engine.

18. The method of claim 17, further comprising monitoring a parameter of the lubrication fluid within the engine, wherein moving the first solenoid valve to the closed position occurs in response to the parameter reaching a predetermined pressure.

19. The method of claim 17, wherein providing hydraulic fluid to operate the second pump comprises providing a first hydraulic fluid flow, and wherein providing hydraulic fluid to operate the hydraulic starter comprises providing a second hydraulic fluid flow, the method further comprising:

reducing the first hydraulic fluid flow with respect to the second hydraulic fluid flow via a flow restriction coupled between the first solenoid valve and the second pump; and regulating pressure variations across the flow restriction via a pressure compensator.

20. The method of claim 17, wherein operating the hydraulic starter comprises:

rotating a shaft of the hydraulic starter; and coupling a rotating portion of the hydraulic starter to a ring gear of the engine.

* * * * *